US008571442B2

(12) United States Patent
Sato et al.

(10) Patent No.: US 8,571,442 B2
(45) Date of Patent: Oct. 29, 2013

(54) IMAGE FORMING APPARATUS HAVING REMOVABLE FIXING DEVICE

(75) Inventors: Hideki Sato, Yokohama (JP); Hiroshi Kon, Yokohama (JP); Jun Sawamura, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 340 days.

(21) Appl. No.: 13/033,076

(22) Filed: Feb. 23, 2011

(65) Prior Publication Data

US 2012/0020701 A1 Jan. 26, 2012

(30) Foreign Application Priority Data

Jul. 23, 2010 (JP) ..... 2010-165810

(51) Int. Cl.
*G03G 15/16* (2006.01)

(52) U.S. Cl.
USPC ..... 399/122

(58) Field of Classification Search
USPC ..... 399/122, 110, 107
See application file for complete search history.

(56) References Cited

U.S. PATENT DOCUMENTS

| | | | | |
|---|---|---|---|---|
| 6,229,974 | B1 | 5/2001 | Noda | |
| 2006/0198678 | A1 * | 9/2006 | Nishimura et al. | 399/406 |
| 2008/0219700 | A1 * | 9/2008 | Saiki et al. | 399/122 |
| 2010/0034559 | A1 * | 2/2010 | Sahara | 399/122 |

FOREIGN PATENT DOCUMENTS

| | | |
|---|---|---|
| JP | 10-254328 | 9/1998 |
| JP | 3347686 B | 9/2002 |
| JP | 2005-077615 | 3/2005 |

* cited by examiner

*Primary Examiner* — Walter L Lindsay, Jr.
*Assistant Examiner* — Rodney Bonnette
(74) *Attorney, Agent, or Firm* — Sughrue Mion, PLLC

(57) ABSTRACT

An image forming apparatus includes: an image forming apparatus main body; an opening and closing part that is attached to the image forming apparatus main body in an openable and closeable manner; and a fixing device that is removably installed in the image forming apparatus main body to fix a developer image onto a recording medium, the opening and closing part being provided with an engaging portion to engage with an engaged portion defined on the image forming apparatus main body, and the engaging portion including a pressing part that presses the fixing device toward a proper position when a part of the fixing device is positioned in a movement locus of the engaging portion during a closing movement of the opening and closing part.

8 Claims, 16 Drawing Sheets

IMAGE FORMING APPARATUS HAVING REMOVABLE FIXING DEVICE

CROSS-REFERENCE TO RELATED APPLICATION

This application is based on and claims priority under 35 USC 119 from Japanese Patent Application No. 2010-165810 filed Jul. 23, 2010.

BACKGROUND

Technical Field

The present invention relates to an image forming apparatus.

SUMMARY

According to an aspect of the present invention, there is provided an image forming apparatus including: an image forming apparatus main body; an opening and closing part that is attached to the image forming apparatus main body in an openable and closeable manner; and a fixing device that is removably installed in the image forming apparatus main body to fix a developer image onto a recording medium, the opening and closing part being provided with an engaging portion to engage with an engaged portion defined on the image forming apparatus main body, and the engaging portion including a pressing part that presses the fixing device toward a proper position when a part of the fixing device is positioned in a movement locus of the engaging portion during a closing movement of the opening and closing part.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described, based on the drawings.

Figure 1:
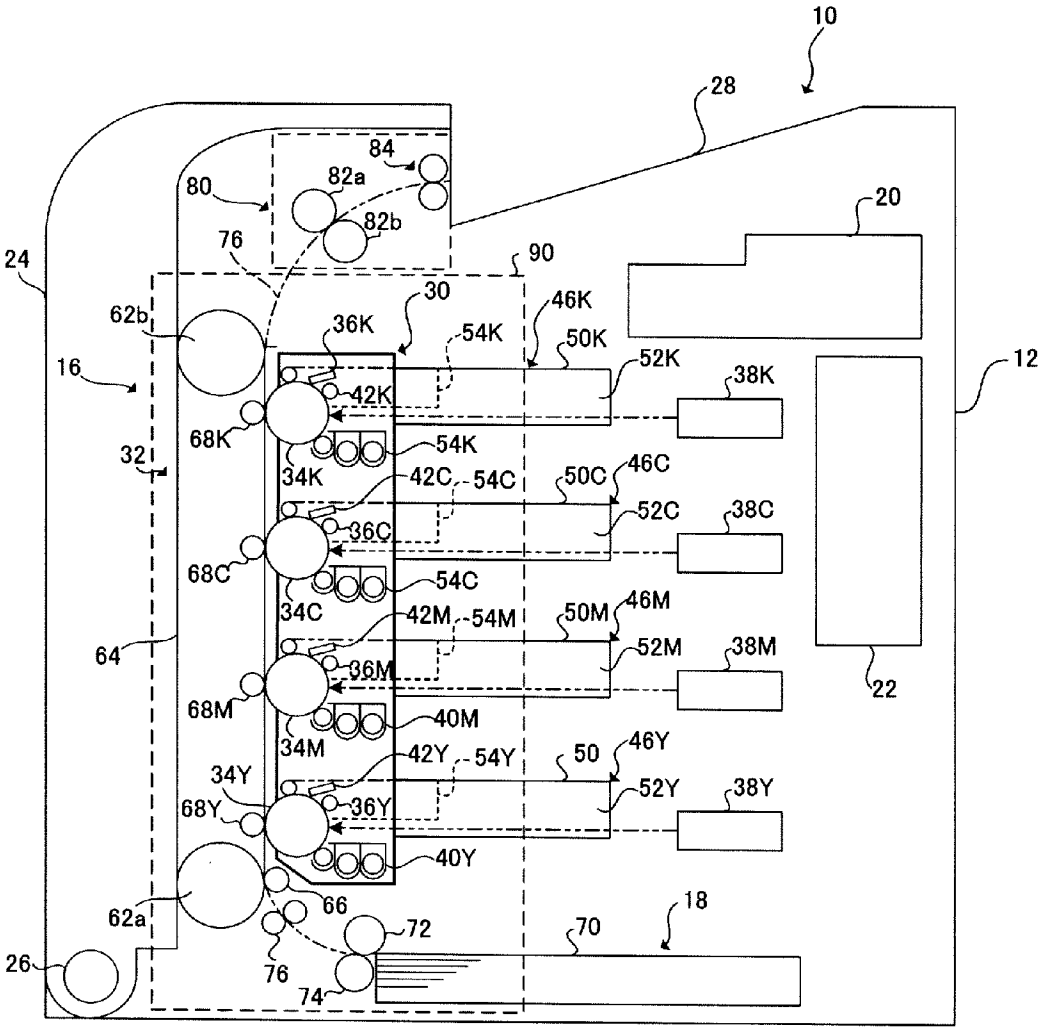
FIG. 1 is a cross-sectional diagram depicting an image forming apparatus to which an exemplary embodiment of the present invention is applied.
Figure 2:
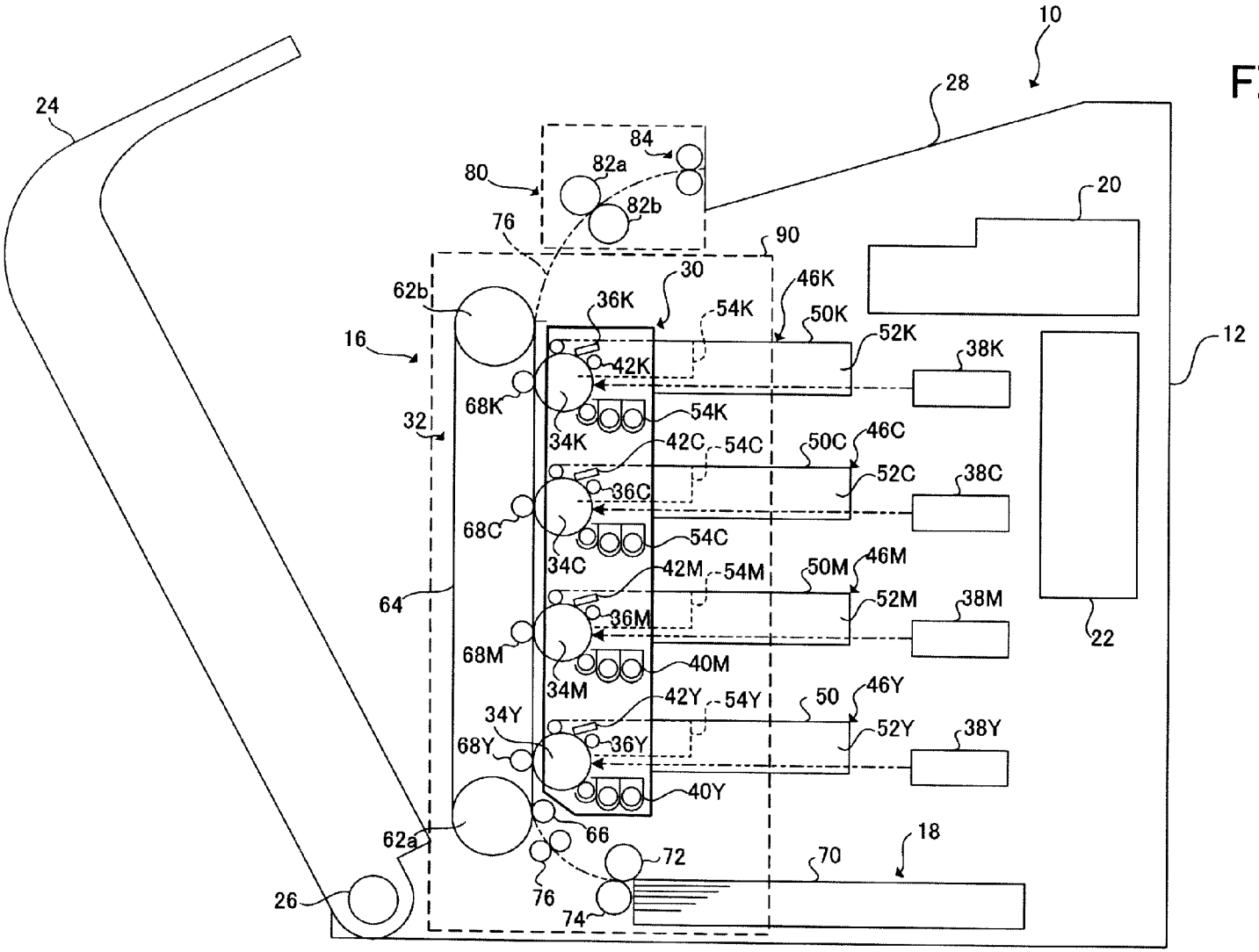
FIG. 2 depicts the image forming apparatus to which the exemplary embodiment of the present invention is applied, with its opening and closing part being open.

FIG. 1 and FIG. 2 show cross-sectional diagrams of an image forming apparatus 10 as an exemplary embodiment of the present invention. FIG. 1 depicts the image forming apparatus with an opening and closing part 24 being closed. FIG. 2 depicts the image forming apparatus with the opening and closing part 24 being open.

The image forming apparatus 10 has an image forming apparatus main body 12.

In the image forming apparatus main body 12, a recording medium feeder 18 that feeds a recording medium to an image output part 16, a power supply unit 20, and a controller 22 that is used as a controller for controlling all components constituting the image forming apparatus 10 are arranged.

The image forming apparatus main body 12 is provided with the opening and closing part 24. The opening and closing part 24 is allowed to turn or swivel about a fulcrum point 26 provided at the bottom of the image forming apparatus main body 12.

When closed, the opening and closing part 24 functions as an outer cover together with the image forming apparatus main body 12.

On the top of the image forming apparatus main body 12, there is provided a medium collector 28 to which a recording medium having an image formed thereon is ejected.

The image output part 16 includes image forming parts 30Y, 30M, 30C, 30K, each dedicated for each of four colors, e.g., yellow (Y), magenta (M), cyan (C), and black (K), and a transfer device 32 used as a transfer unit that transfers a developer image to a recording medium.

The image forming parts 30Y, 30M, 30C, 30K and their components are configured in the same way, except for the colors of images that they form. Hereinafter, they may be denoted by a collective designation such as an "image forming part 30" without Y, M, C, K, particularly when a unit structure dedicated for each color is described.

The image forming parts 30 are of an electrophotographic type that produces a color image.

Each image forming part 30 includes: a photoreceptor 34 in form of a drum as an image carrier that carries a developer image; a charging device 36 as a charging unit equipped with a charging roller that evenly charges the photoreceptor 34; an optical projection device 38 as a latent image forming unit that projects an electrostatic latent image by light onto the photoreceptor 34; a development device that develops a latent image projected onto the photoreceptor 34 with developer (toner); and a cleaning device 42 that cleans the photoreceptor 34, for example, by scraping away waste developer particles remaining on the photoreceptor 34.

Each optical projection device 38 is formed of a laser illuminator and is adapted to emit a laser beam to the photoreceptor 34 dedicated for each color and project a latent image onto the photoreceptor 34.

Among the members included in each of the image forming parts 30, the photoreceptor 34, charging device 36, development device 40, and cleaning device 42 are assembled in a process cartridge 46 which is used as a replacement unit.

The process cartridges 46 are removably installed in the apparatus from the front (left in FIG. 1) of the image forming apparatus main body 12.

A developer cartridge 50 as a replacement unit that contains developer to be supplied to each of the development devices 40 is removably inserted into a process cartridge 46 from a lateral side of the image forming apparatus main body 12.

Inside each of the developer cartridges 50, a developer containing chamber 52 containing developer and a waste developer collecting chamber 54 are defined.

A developer cartridge 50 is filled with (contains) color developer for which the development device (image forming part) is responsible.

The transfer device 32 includes: two support rollers 62*a*, 62*b*; a transport belt 64 as a transport unit that transports a recording medium; an adsorption roller 66 as an adsorption unit that makes a recording medium adsorbed onto the surface of the transport belt 64; and transfer rollers 68, each located to adjoin each of the photoreceptors 34, that respectively transfer a developer image formed on the surface of each photoreceptor 34 onto a recording medium being transported on the transport belt 64.

The transfer device 32 is an assembly as a unit.

The adsorption roller 66 is installed, pressed against and brought in contact with the support roller 62*a*, the transport belt 64 passing between these rollers. A voltage is applied to the adsorption roller 66 from the power supply unit 20, so that the adsorption roller 66 makes a recording medium adsorbed onto the surface of the transport belt 64 by electrostatic adsorption.

A transfer bias is applied to the transfer rollers 68, respectively. The transfer rollers 68 are adapted to sequentially transfer a developer image formed on each of the photoreceptors 34 onto a recording medium being transported on the transport belt 64, so that developer images of four colors of Y, M, C, K are overlayingly transferred to the recording medium and, finally, a color developer image is formed on the medium.

The recording medium feeder 18 includes: a recording medium container 70 in which recording media are stacked and contained; a feed roller 72 that takes out a top recording medium from the stack contained in the recording medium container 70 and feeds the recording medium taken out toward the image output part 16; and a retard roller 74 that serves to separate the recording medium to be fed from the stack, thus preventing multiple sheets of recording media from being fed to the image output part 16 in a state that they cling together.

Inside the image forming apparatus main body 12, a transport path 76 is provided to transport the recording medium fed from the feeder 18 up to the medium collector 28.

Along the transport path 76, the feed roller 72 and retard roller 74, registration rollers 78, the transfer device 32, and a fixing device 80 are arranged in order from upstream in a recoding medium transport direction.

The registration rollers 78 temporarily stop the forward end of the recording medium moved from the recording medium feeder 18 and send forth the recording medium toward the transfer device 32 in time with timing to proceed to image formation.

The fixing device 80 in the present exemplary embodiment incorporates an ejector 84. The fixing device 80 is removably installed in the image forming apparatus main body 12.

The fixing device 80 includes a heating roller 82*a* and a pressure roller 82*b* and fixes a developer image onto a recording medium by applying heat and pressure to the recording medium passing between these heating roller 82*a* and pressure roller 82*b*.

The ejector 84 ejects recording medium having a developer image fixed onto it by the fixing device 80 to the medium collector 28.

Inside the image forming apparatus main body 12, there is provided a frame (sub-chassis) 90 that form a part of the image forming apparatus main body 12. In this frame 90, the image output part 16, fixing device 80, etc. are installed and supported.

Next, details on the opening and closing part 24 are described.

Figure 3:
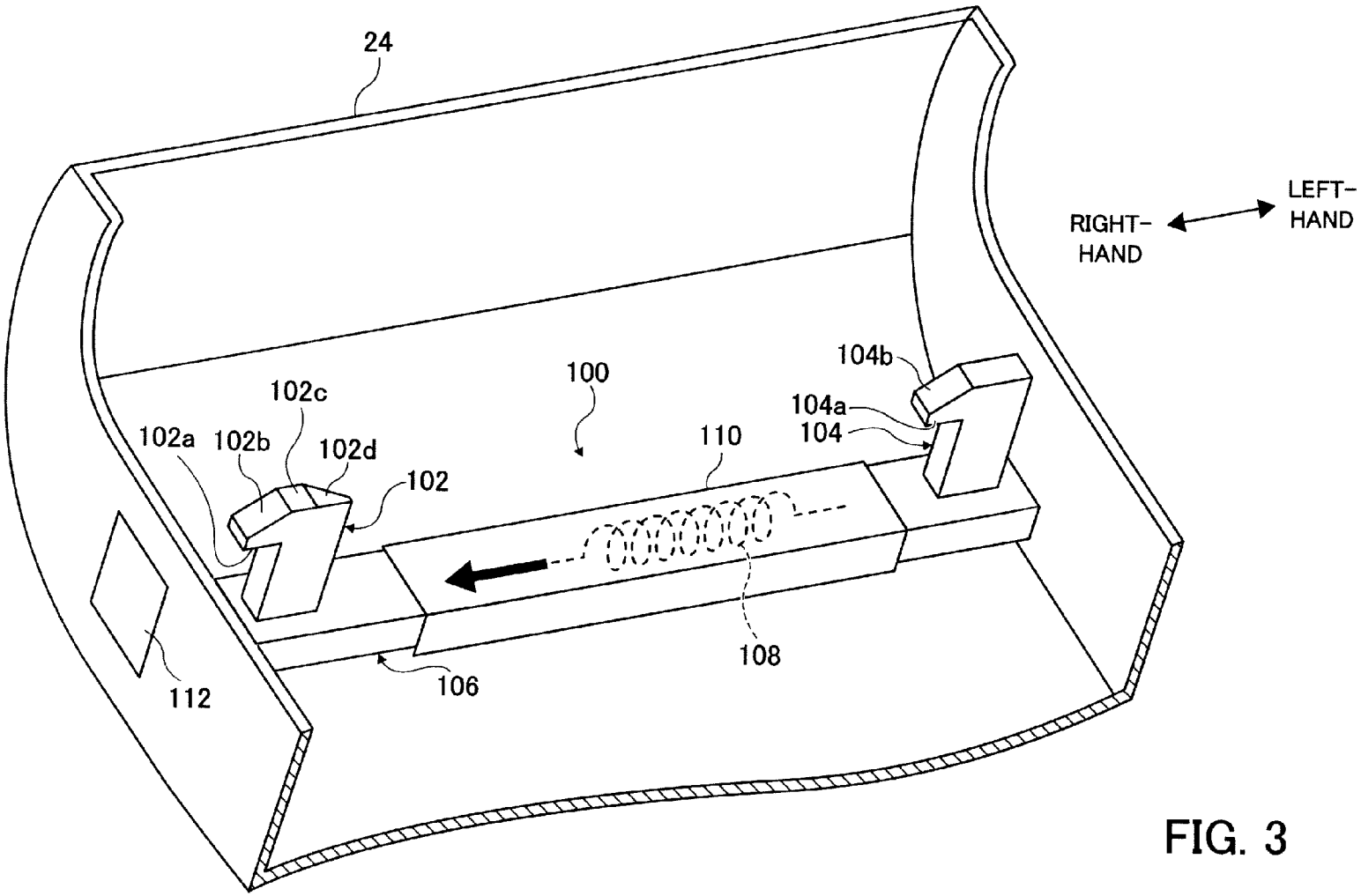
FIG. 3 shows an enlarged perspective view of the opening and closing part.

FIG. 3 shows an enlarged perspective view of the opening and closing part 24.

Hereinafter, the position (positional relation) of any one of components, parts, and portions constituting the image forming apparatus 10 may be represented using wording of frontward, rearward, left-hand, right-hand, upward, or downward of the image forming apparatus 10, based on the assumption that the image forming apparatus 10 is viewed from the front (left in FIG. 1).

A front-back direction of the image forming apparatus 10 is taken as an X direction, its vertical (substantially vertical) direction is taken as a Y direction, and its transverse direction is taken as a Z direction. A particular position may be represented in terms of X, Y, and Z directions which are at right angles to one another.

For any one of parts or components constituting the image forming apparatus 10, the above positional relation thereof is represented, based on the assumption that the parts or components are installed or assembled in the image forming apparatus main body 12 or the open and closing part is closed (the state shown in FIG. 1).

In the opening and closing part 24, a latching device 100 is provided. The latching device 100 includes: a movable member 106 with a pressing part 102 and a coupling part 104 disposed at both ends of its transversely extending body; an urging member 108 that urges the movable member 106 toward a right-hand direction, a movably supporting member 110 that supports the movable member 106 to be movable in a transverse direction; and a open/close operational part 112 that is provided at a right-hand end of the movable member 106 and exposed on the outside of the image forming apparatus main body 12.

A mechanism of the latching device 100 and a first engaged portion 162 and a second engaged portion 176 provided on the frame 90 restrains opening and closing movement of the opening and closing part 24.

The pressing part 102 includes: an engaging portion 102*a* that protrudes toward the right-hand direction (the direction in which the urging member 108 exerts urging force); a guiding portion 102*b* that slopes up leftward to a tip portion from the engaging portion 102*a* (from the X direction toward the Z direction); the tip portion 102*c*; and a downslope portion 102*d* (sloping down leftward) formed from the tip portion 102*c* toward a left-hand direction such that its dimension in the Y direction becomes smaller (thinner).

The downslope portion 102*d* thus provided in the pressing part 102 allows for saving space in the Y direction, while maintaining the mechanical strength of the pressing part 102 (particularly, the strength in the Z direction in which the pressing part moves), as compared with a similar pressing part structure but without such downslope portion.

During a rearward travel of the pressing part 102, when there exists a blockade in the path of travel of the guiding portion 102*b*, the pressing part 102 is guided by the guiding portion 102*b* so that it will move in the Z direction against the urging force of the urging member 108.

The coupling part 104 includes: an engaging portion 104*a* that protrudes toward the right-hand direction (the direction in which the urging member 108 exerts urging force); and a guiding portion 104*b* that slopes up leftward to a tip from the engaging portion 104*a* (from the X direction toward the Z direction).

The coupling part 104 may be provided with a downslope portion (not shown) formed from the tip toward the left-hand direction such that its dimension in the Y direction becomes smaller (thinner).

During a rearward travel of the coupling part 104, when there exists a blockade in the path of travel of the guiding portion 104*b*, the coupling part 104 is guided by the guiding portion 104*b* so that it will move in the Z direction against the urging force of the urging member 108.

Along with the movement of the pressing part 102 and the coupling part 104, the movable member 106 moves in the Z direction. When an operator pushes in the open/close operational part 112 toward the left (inward of the image forming apparatus main body 12), the moveable member 106 is to move leftward against the urging force of the urging member 108.

Next, details on the fixing device 80 are described.

Figure 4:
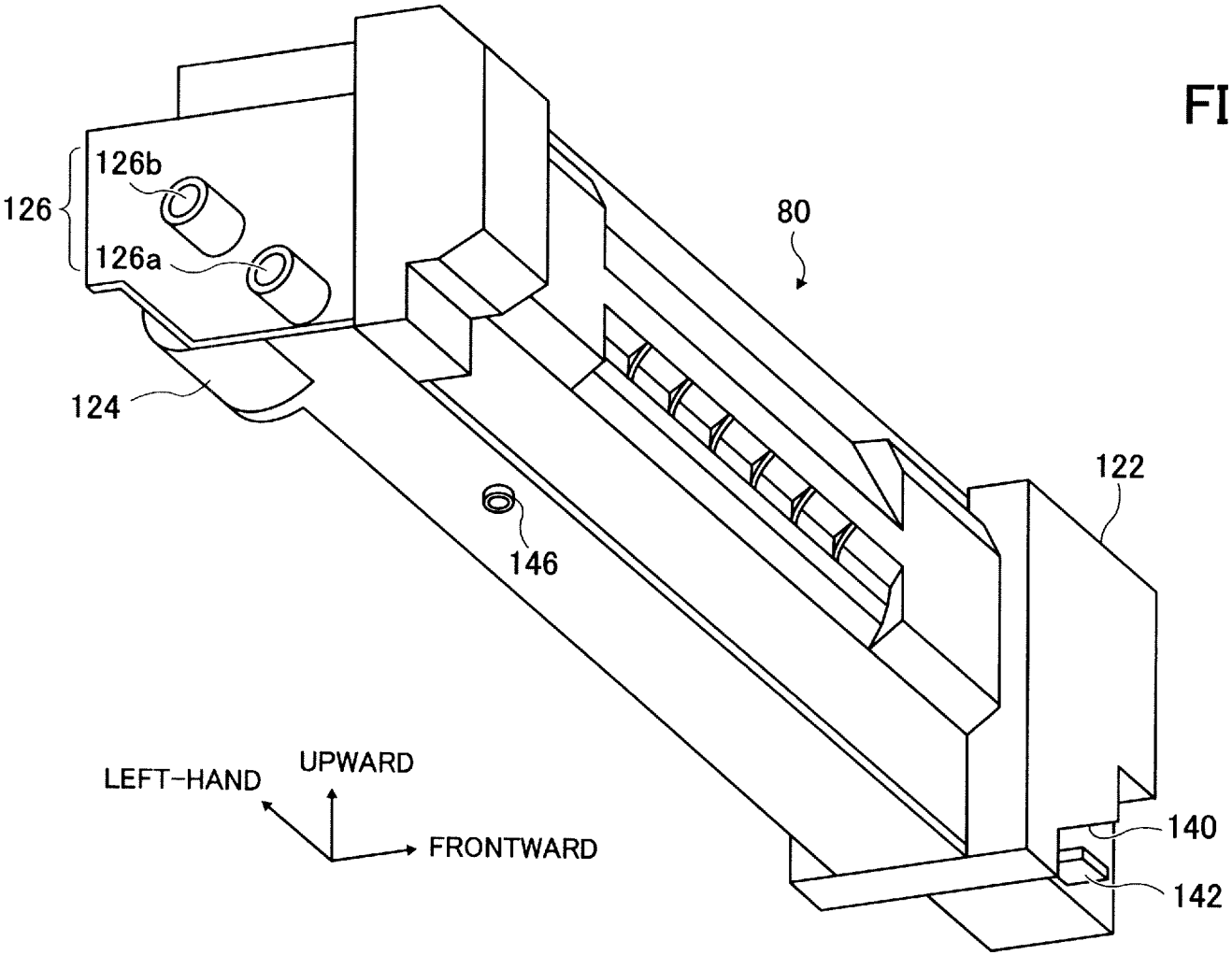
FIG. 4 is a perspective view of a fixing device as viewed from below left at the front side.
Figure 5:
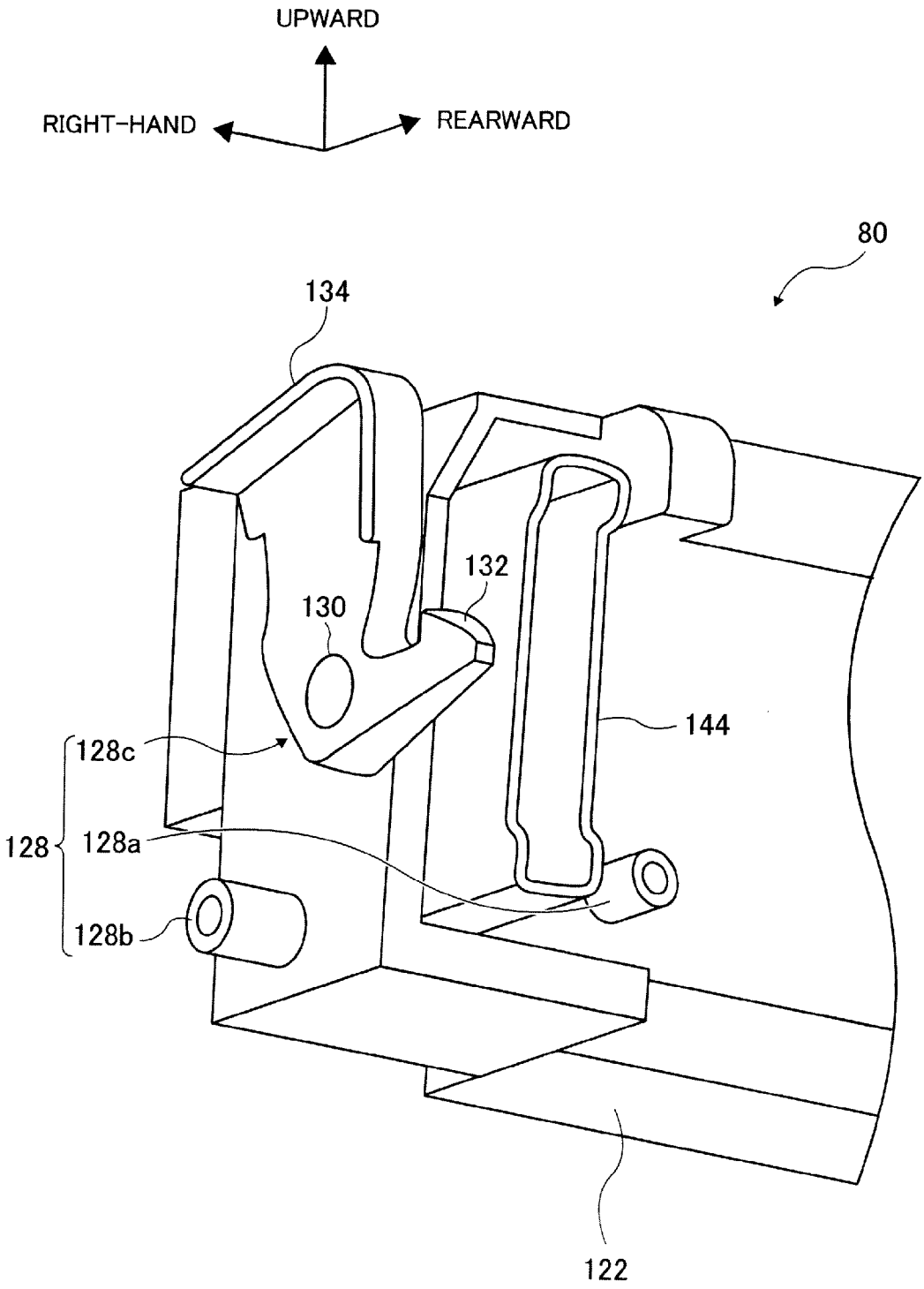
FIG. 5 is an enlarged perspective view of the fixing device as viewed from below left at the rear side.

FIG. 4 shows a perspective view of the fixing device 80 as viewed from below left at the front side. FIG. 5 shows an enlarged perspective view of the fixing device 80 as viewed from below left at the rear side.

The fixing device 80 has a roughly box-shaped housing 122. Inside the housing 122, the fixing device 80, the ejector 84, a gear 124, etc. are accommodated.

The gear 124 receives driving force by meshing with a drive gear (not shown) as a drive source provided on the frame 90 and conveys the driving force to the heating roller 82*a* and the pressure roller 82*b* of the fixing device 80, the ejector 84, etc.

The gear is disposed at the left of the housing 122 and a part thereof is exposed from the bottom of the housing 122.

In a left end of the housing 122, a first positioning portion 126 is provided that connects with the frame 90 in the left end. The first positioning portion 126 is disposed near the gear 124.

The first positioning portion 126 includes a first boss 126*a* and a second boss 126*b*.

The first boss 126*a* is a columnar protrusion and protrudes substantially at right angle (in the Z direction) from the left lateral side of the housing 122.

The second boss 126*b* is a columnar protrusion disposed behind and above the first boss 126*a* and protrudes substantially at right angle (in the Z direction) from the left lateral side of the housing 122.

In a right end of the housing 122, a second positioning portion 128 is provided that connects with the frame 90 in the right end.

The second positioning portion 128 includes a third boss 128*a*, a fourth boss 128*b*, and a latch 128*c*.

The third boss 128*a* is a columnar protrusion and protrudes substantially at right angle (in the X direction) from the right rear side (rear lateral side) of the housing 122.

The fourth boss 128*b* is a columnar protrusion and protrudes substantially at right angle (in the Z direction) from the right lateral side of the housing 122.

The latch 128*c* is a member that sways about a shaft 130 provided on the right lateral side of the housing 122 and includes a hook portion 132 and a grip portion 134.

The hook portion 132 is urged upward by an elastic member (not shown) such as a spring. The latch 128*c* is adapted to allow the hook portion 132 to move downward against the urging force of the elastic member when an operator grips the grip portion 134 and moves it upward.

The tip of the hook portion 132 is formed into a curve. Thus, during a rearward travel of the hook portion 132 (fixing device 80), when there exists a blockade to hit against the curve of the hook portion 132, the hook portion 132 will move downward against the urging force of the elastic member, as it travels in the X direction.

In a lower part of the right front side of the housing 122, a pressed portion 140 is provided that protrudes frontward. At left of the pressed portion 140, a slope catcher 142 sloping down leftward is formed.

When the tip portion 102*c* of the pressing part 102 of the opening and closing part 24 comes in contact with the pressed portion 140, the downslope portion 102*d* of the pressing part 102 is positioned under the slope catcher 142.

On the right rear side (rear lateral side) of the housing 122, a fixing device's connector 144 is provided.

The fixing device's connector 144 connects with a frame's connector 180 (see FIG. 15, inter alia) attached to the frame 90.

In the underside of the housing 122, a fifth boss 146 is provided that connects with the frame 90 in the underside.

The fifth boss 146 is a columnar protrusion and protrudes substantially at right angle (in the Y direction) from the underside of the housing 122.

Next, details on the frame 90 are described.

Figure 6:
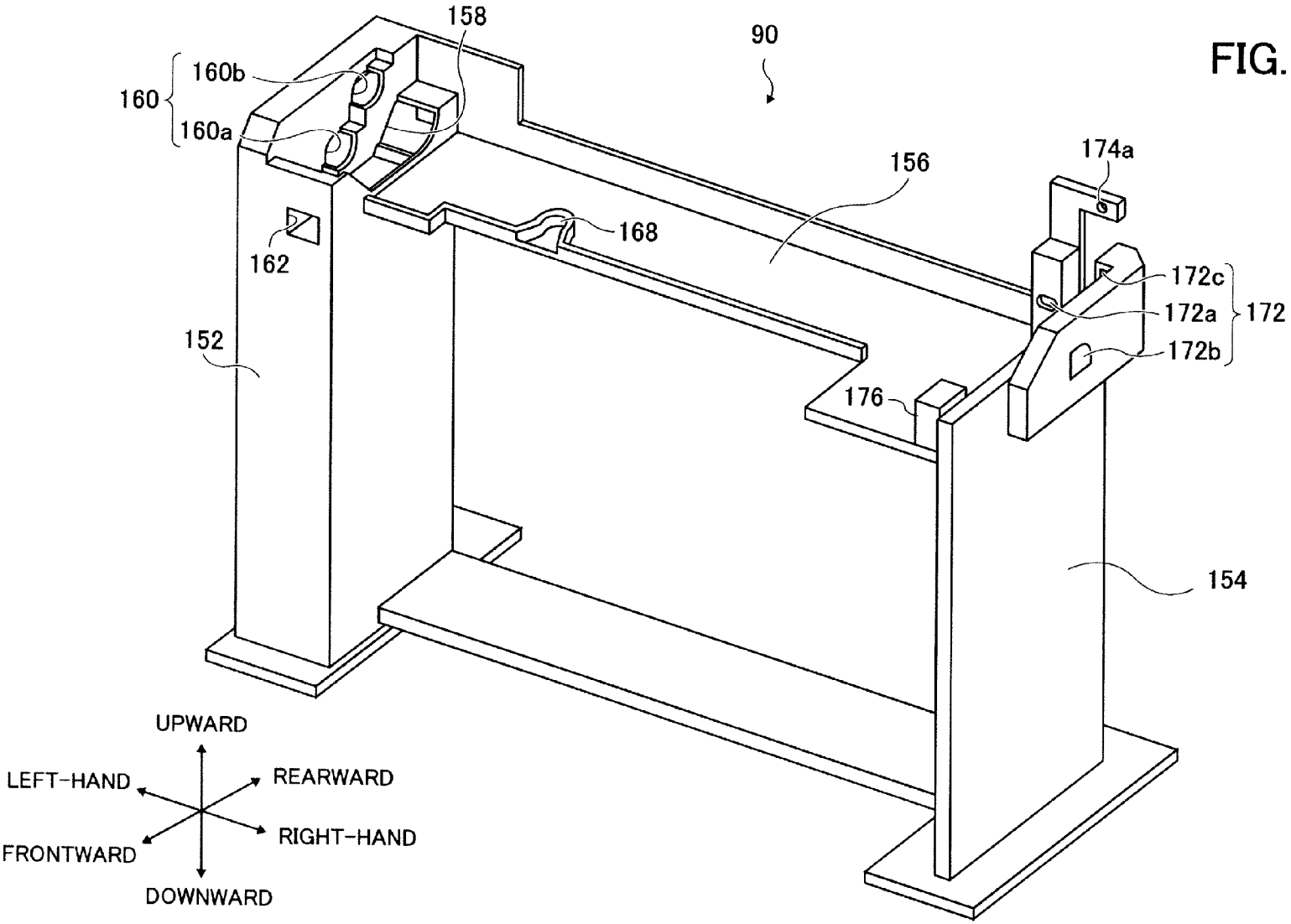
FIG. 6 is a perspective view of a frame as viewed from above right at the front side.
Figure 7:
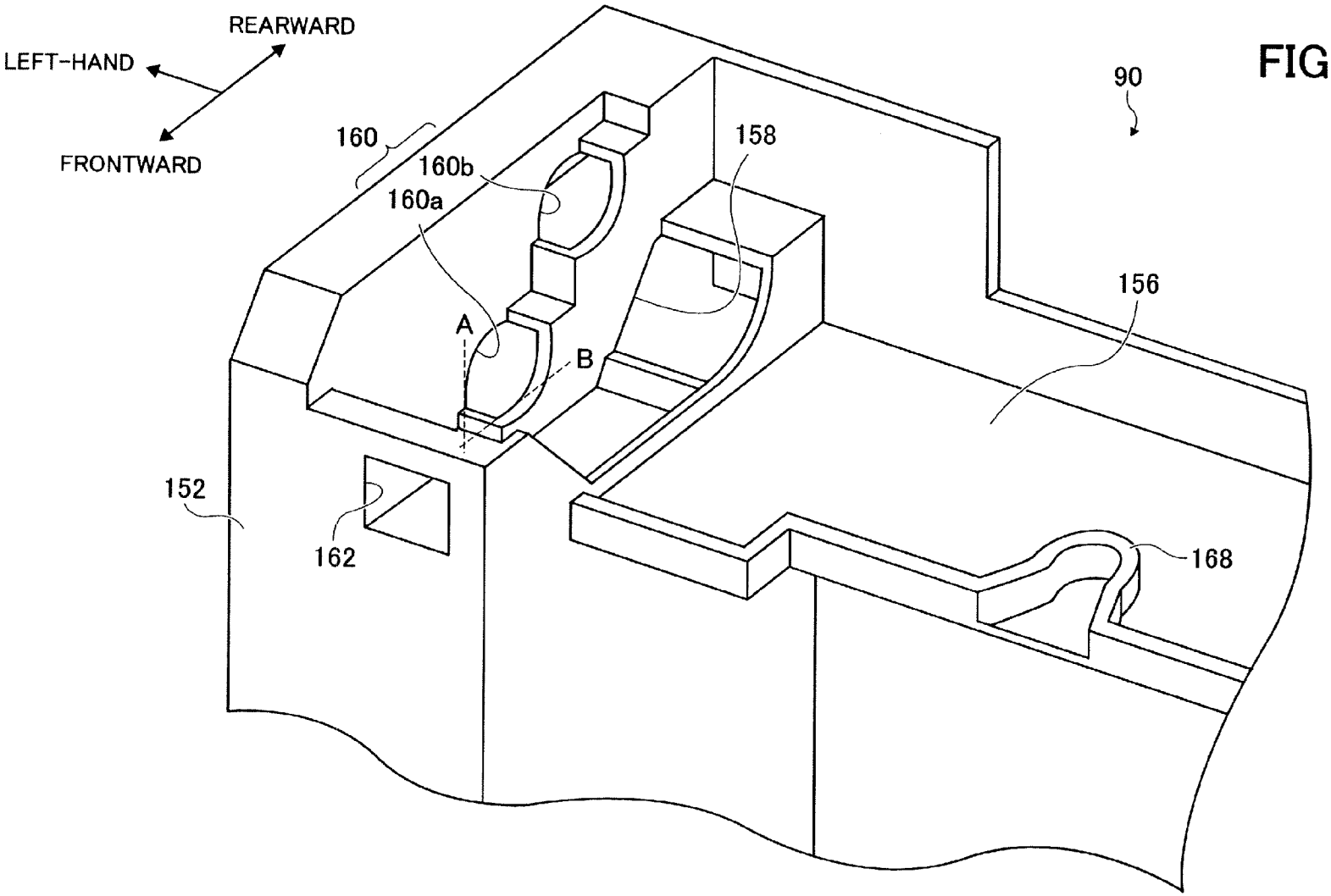
FIG. 7 is an enlarged perspective view of an upper left part of the frame.
Figure 8:
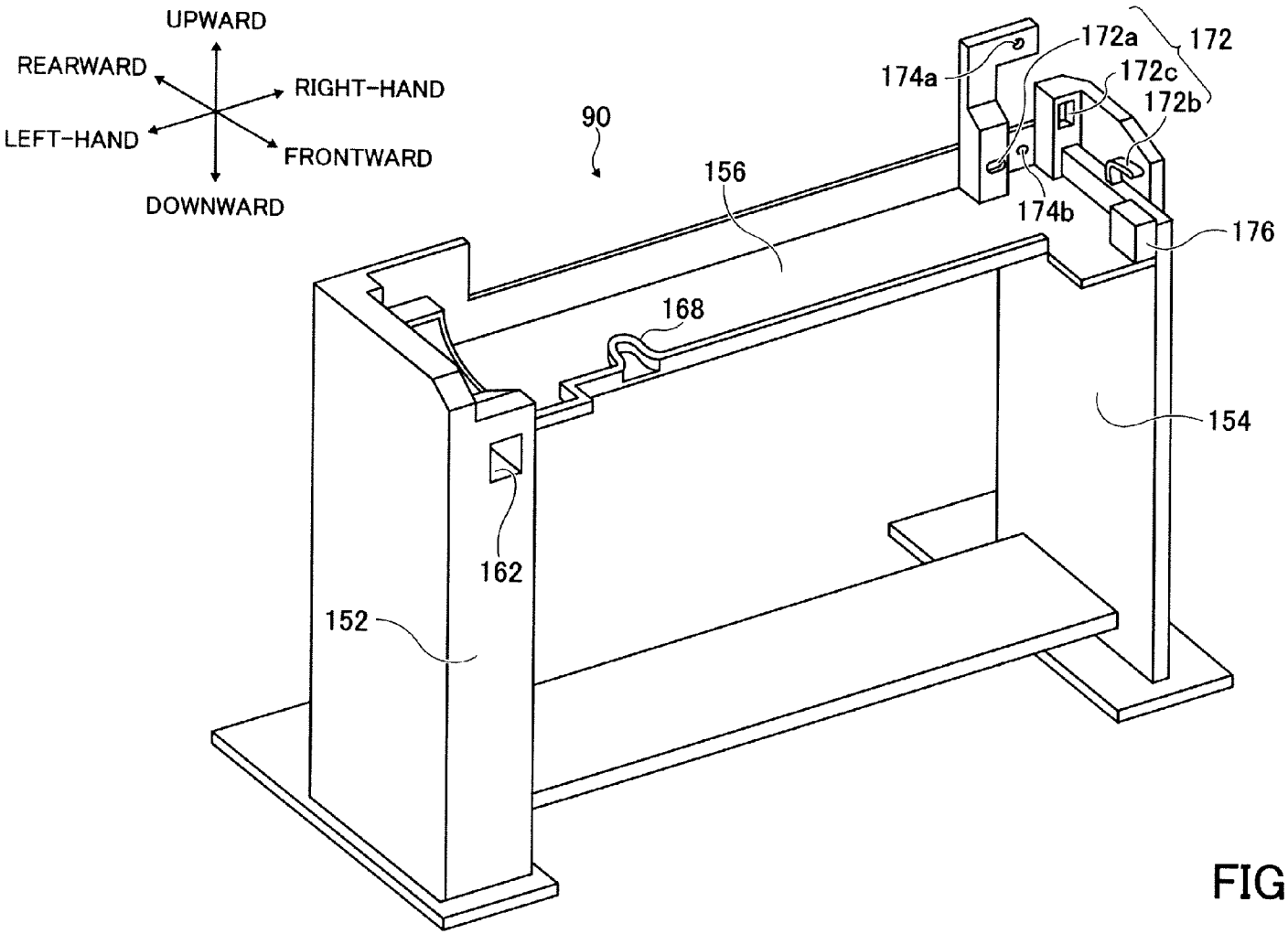
FIG. 8 is a perspective view of the frame as viewed from above left at the front side.

FIG. 6 shows a perspective view of the frame 90 as viewed from above right at the front side, FIG. 7 shows an enlarged perspective view of an upper left part of the frame 90, and FIG. 8 shows a perspective view of the frame 90 as viewed from above left at the front side.

The frame 90 includes a first lateral part 152, a second lateral part 154, and an upper plate part 156. On the top of the upper plate part 156, the fixing device 80 is mounted.

The first lateral part 152 is positioned in a left-hand region within the image forming apparatus main body 12. On the top surface of the first lateral part 152, a hole for gear 158 and a first positioned portion 160 are defined.

In an upper area of the front side of the first lateral part 152, a first engaged portion 162 is defined.

The hole for gear 158 is provided to allow the gear 124 of the fixing device 80 to be fit in it, so that the drive gear (not shown) disposed inside the first lateral part 152 meshes with the gear 124.

The first positioned portion 160 includes a first boss catcher 160*a* and a second boss catcher 160*b*.

The first boss catcher 160*a* is a hole into which the first boss 126*a* of the fixing device 80 is inserted and fit.

For the first boss catcher 160*a*, its recess is defined to protrude inward of the first lateral part 152, the recess does not face its upper portion, and a part of it is formed to be open upward. That is, the first boss catcher 160*a* allows the first boss 126*a* to be fit in it from above.

Moreover, the first boss catcher 160*a* is formed so that its dimensions in the X and Y directions (inner diameters) are substantially equal to the dimensions (outer diameters) of the first boss 126*a*.

The second boss catcher 160*b* is disposed behind and above the first boss catcher 160*a*. The second boss catcher 160*b* is a hole into which the second boss 126*b* of the fixing device 80 is inserted and fit.

For the second boss catcher 160*b*, its recess is defined to protrude inward of the first lateral part 152, the recess does not face its upper portion, and a part of it is formed to be open upward. That is, the second boss catcher 160*b* allows the second boss 126*b* to be fit in it from above.

Moreover, for the second boss catcher 160*b*, its dimension in the Y direction is substantially equal to the corresponding dimension of the second boss 126*b* (outer diameters) of the first boss 126*a*, whereas its dimension in the X direction is larger than the corresponding dimension of the second boss 126*b*.

The first engaged portion 162 is defined such that the coupling part 104 of the opening and closing part 24 is engaged with it.

The second lateral part 154 is positioned a right-hand region within the image forming apparatus main body 12. In an upper end section of the second lateral part 154, there are provided a second positioned portion 172, screw holes 174*a*, 174*b*, and a second engaged portion 176.

The second positioned portion 172 includes a third boss catcher 172*a*, a fourth boss catcher 172*b*, and a latch catcher 172*c*.

The third boss catcher 172*a* is a hole into which the third boss 128*a* of the fixing device 80 is inserted and fit. For the third boss catcher 172*a*, its dimension in the Y direction is substantially equal to the corresponding dimension of the third boss 128*a*, whereas dimension in the Z direction is larger than the corresponding dimension of the third boss 128*a*.

The fourth boss catcher 172*b* is a chased hole disposed in a position substantially facing the first positioned portion 160 and allowing the fourth boss 128*b* of the fixing device 80 to slide and be fastened in it. The fourth boss catcher 172*b* has a configuration in which its front and left (inward) sides are open and its top, bottom, and rear sides are closed. For the fourth boss catcher 172*b*, its dimension in the Y direction, which is defined by its closed sides, is substantially equal to the corresponding dimension of the fourth boss 128*b*.

The latch catcher 172*c* is a hole into which the latch 128*c* of the fixing device 80 is inserted substantially in the X direction and engaged.

The latch catcher 172*c* and latch 128*c* may be engaged and disengaged (detached) by the application of a given amount of force in a given direction, for example, like a snap fit or the like, without movement of the grip portion 134.

The screw holes 174*a*, 174*b* are holes for installing the frame's connector 180 (see FIG. 10, inter alia) for making electrical connection between the frame 90 and the fixing device 80. For example, the frame's connector 180 is provided to be installed between the third boss catcher 172*a* and the latch catcher 172*c*.

The second engaged portion 176 is a protrusion having a predetermined dimension in the X direction and protruding inward. The pressing part 102 of the opening and closing part 24 is engaged with the second engaged portion 176.

The tip 176*a* of the second engaged portion 176 is positioned to correspond to the extent in the Z direction of the guiding portion 102*b* when the pressing part 102 is urged and placed in its (rightmost) position in the Z direction. The above tip protrudes in a movement locus of the pressing part 102 during closing movement of the opening and closing part 24. That is, when the opening and closing part 24 is closed, the guiding portion 102*b* of the pressing part 102 comes in contact with the second engaged portion 176.

The upper plate part 156 is a plate part that lays substantially horizontally between the first lateral part 152 and the second lateral part 154 and includes a fifth boss catcher 168.

The fifth boss catcher 168 is a chased hole allowing the fifth boss 146 of the fixing device 80 to slide and be fit in it. For the fifth boss catcher 168, its dimension in the Z direction is substantially equal to the corresponding dimension of the fifth boss 146. Its configuration is such that its front and top sides are open and its rear side is closed.

Next, the structure of the fixing device 80 when installed in its proper position is described.

FIGS. 9 through 12 depict the fixing device 80 when installed in its proper poison in the frame 90.

Figure 9:
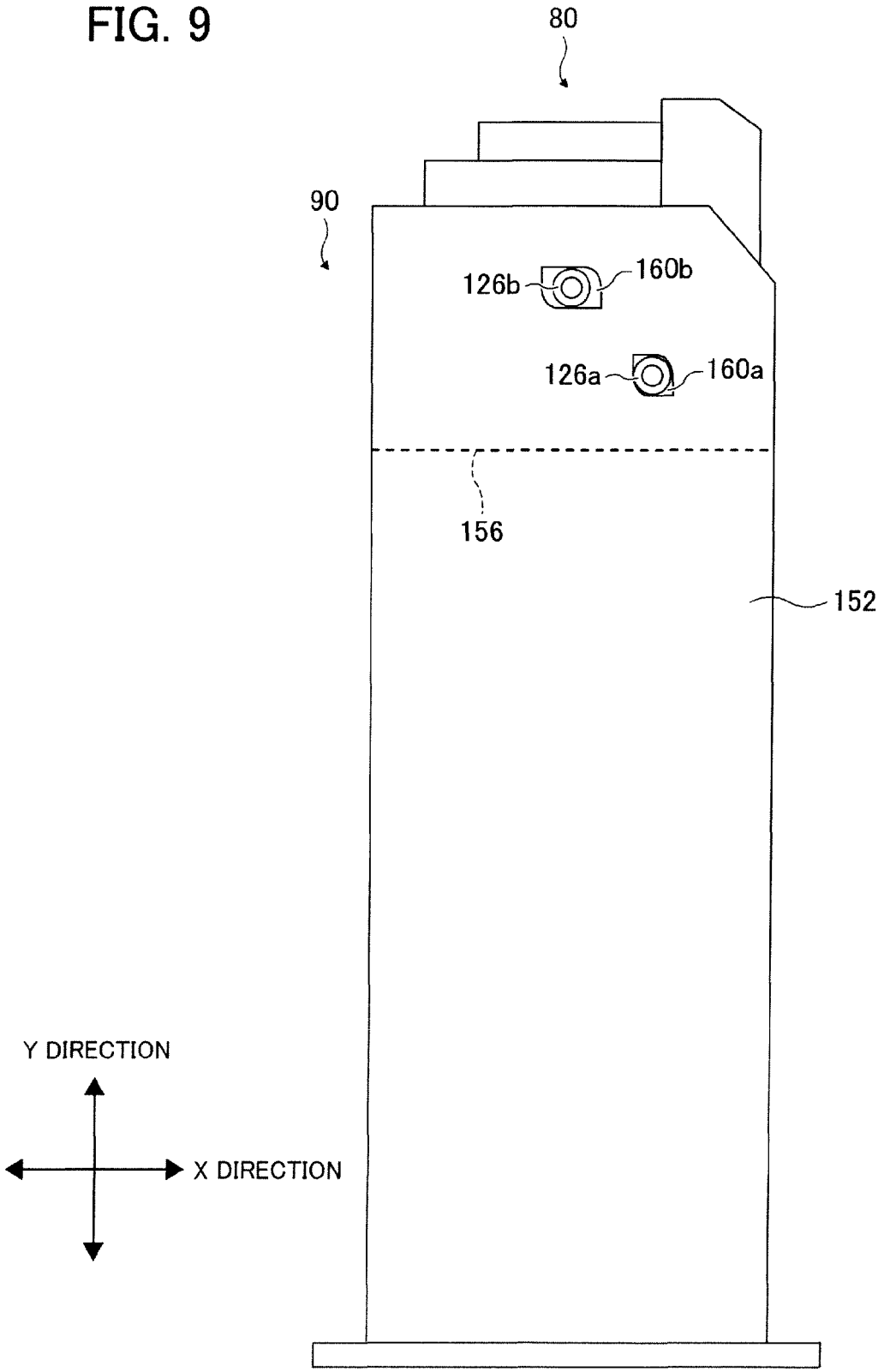
FIG. 9 is a side view of a fixing device when installed in the frame, as viewed from left.
Figure 10:
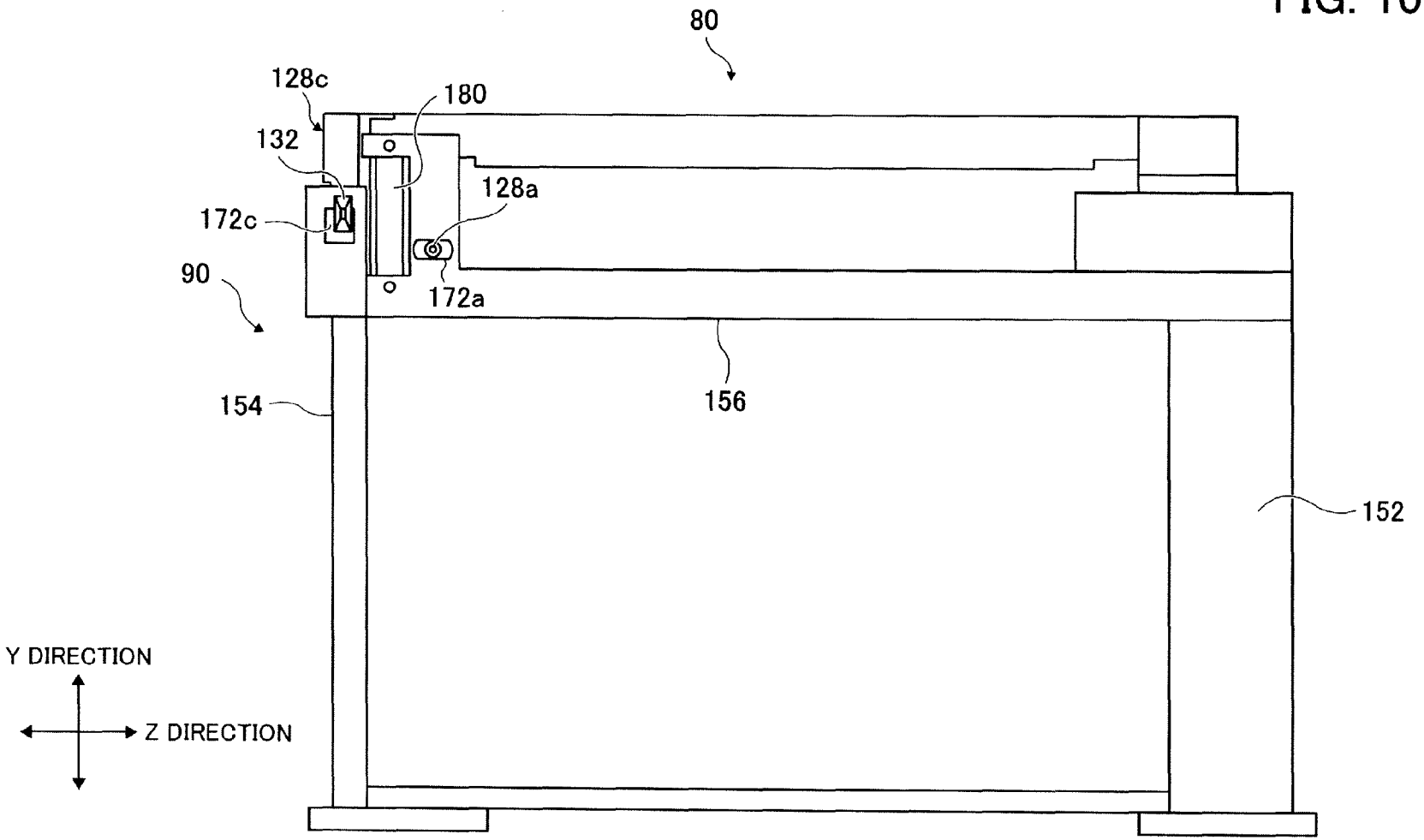
FIG. 10 is a rear view of the fixing device when installed in the frame, as viewed from back.
Figure 11:
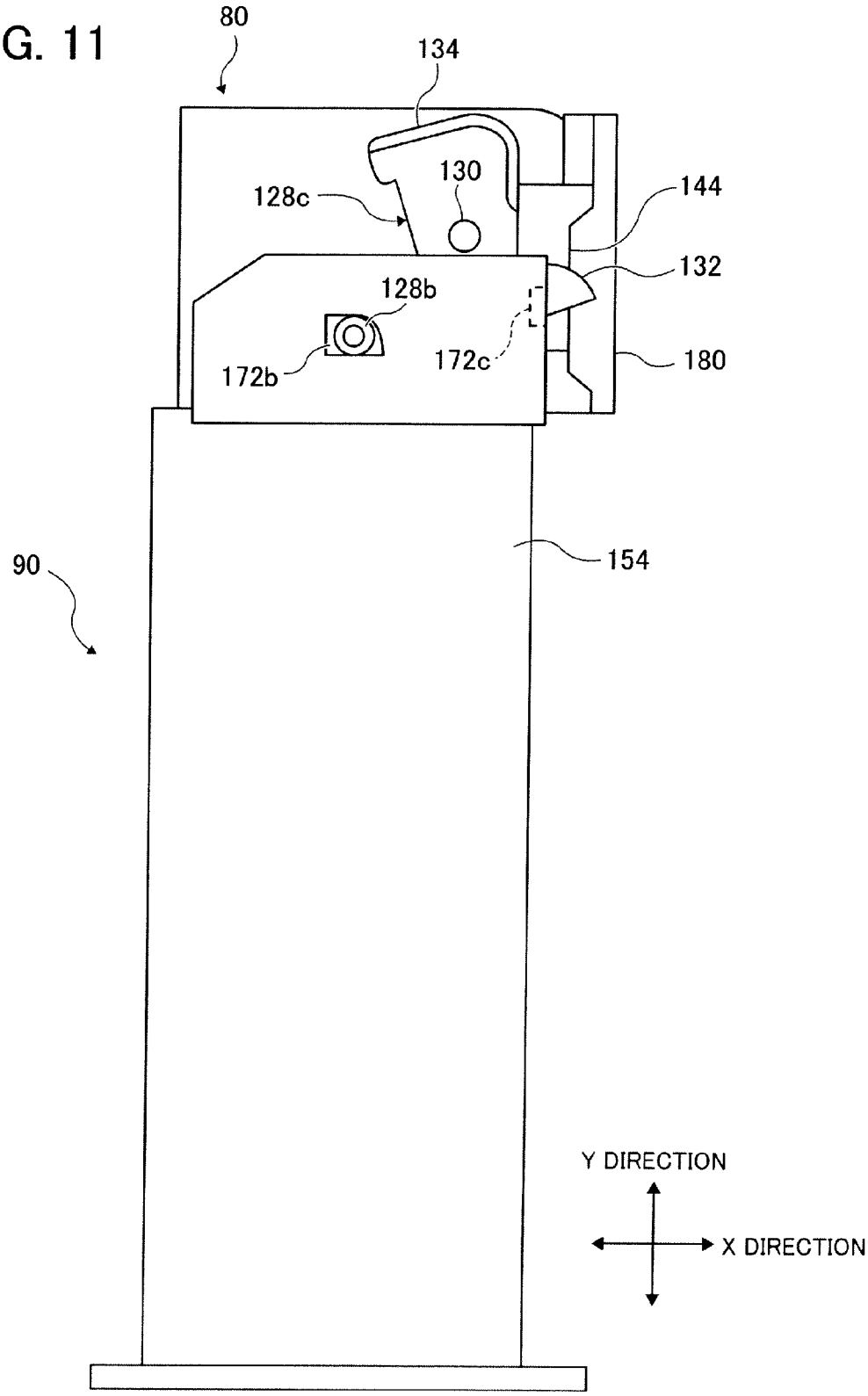
FIG. 11 is a side view of the fixing device when installed in the frame, as viewed from right.
Figure 12:
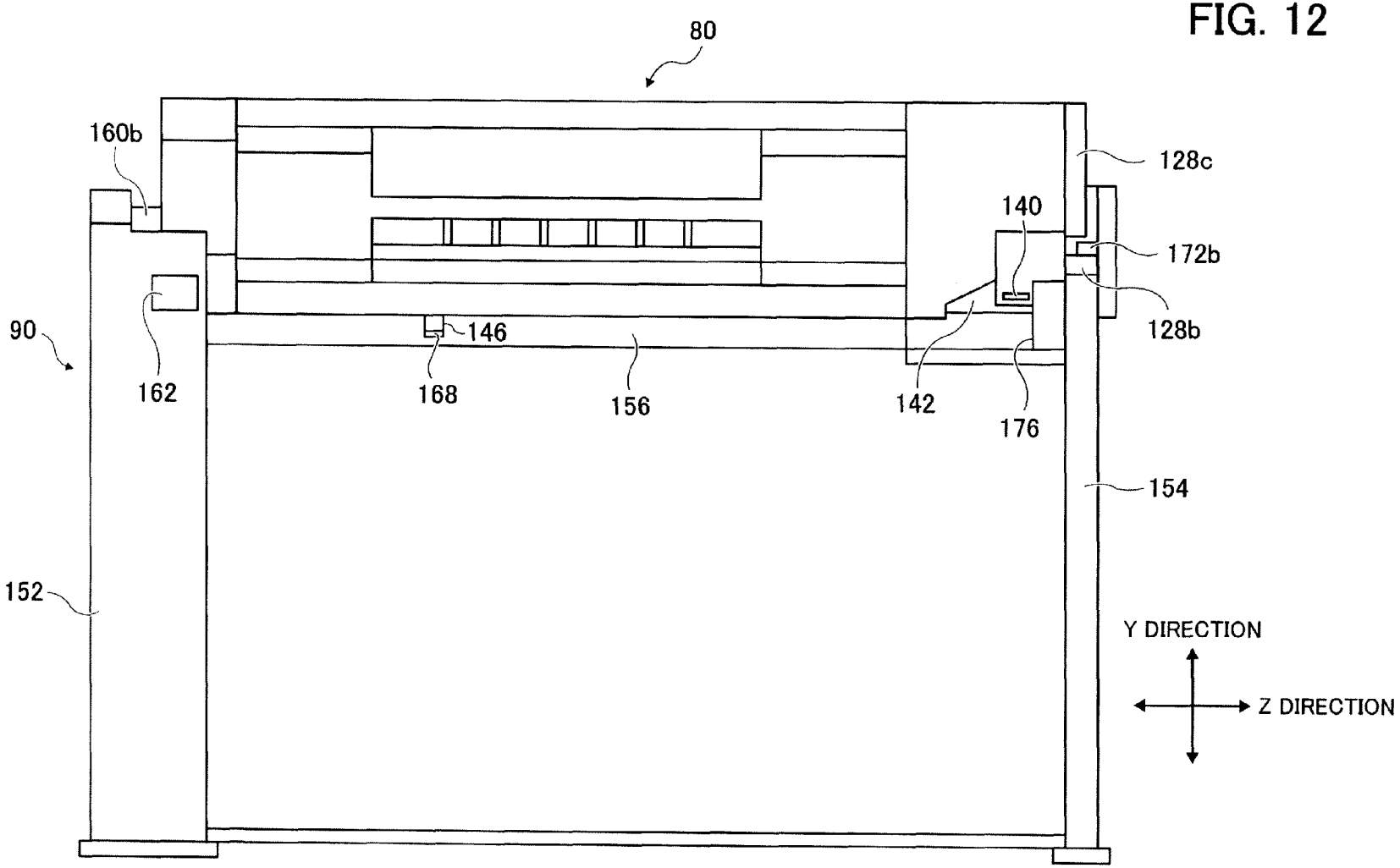
FIG. 12 is a front view of the fixing device when installed in the frame, as viewed from front.

FIG. 9 shows a side view of the fixing device as viewed from left, FIG. 10 shows a rear view of the fixing device as viewed from back, FIG. 11 shows a side view of the fixing device as viewed from right, and FIG. 12 shows a front view of the fixing device as viewed from front.

As shown in FIG. 9, the first boss catcher 160*a* is formed such that there is no play for the first boss 126*a* in the X and Y directions. Thus, the first boss catcher 160*a* restrains the first boss 126*a* from moving in the X and Y directions.

The second boss catcher 160*b* is formed such that there is no play for the second boss 126*b* in the Y direction, but there is play in the X direction. Thus, the second boss catcher 160*b* restrains the second boss 126*b* from moving in the Y direction and restrains the hosing 122 from rotating about the first boss 126*a*.

As shown in FIG. 10, the third boss catcher 172*a* is formed such that there is no play for the third boss 128*a* in the Y direction. Thus, the third boss catcher 172*a* restrains the third boss 128*a* from moving in the Y direction and restrains the housing 122 of the fixing device 80 from rotating about the first boss 126*a*.

As shown in FIG. 11, the fourth boss catcher 172*b* is formed such that there is no play for the fourth boss 128*b* in the Y direction, but there is play in the X direction (frontward). Thus, the fourth boss catcher 172*b* restrains the fourth boss 128*b* from moving in the Y direction and restrains the housing 122 from rotating about the engagement portion between the latch catcher 172*c* and the hook portion 132.

As shown in FIG. 12, the fifth boss catcher 168 is formed such that there is no play for the fifth boss 146 in the Z direction. Thus, the fifth boss catcher 168 restrains the fifth boss 146 from moving in the Z direction.

The latch 128*c* is inserted substantially in the X direction (from font to rear) into the latch catcher 172*c* and, thereby, it is engaged with the latch catcher 172*c*. Thus, this engagement restrains the housing 122 from moving in the X direction (frontward).

When the fixing device 80 is installed in its proper position, the latch 128*c* is engaged with the latch catcher 172*c*. In other words, when the latch 128*c* is engaged with the latch catcher 172*c*, the fixing device 80 is installed in its proper position.

When the fixing device 80 is installed in its proper position, the fixing device's connector 144 provided on the housing 122 is connected to the frame's connector 180 attached to the frame 90. At the same time, the gear 124 meshes with the drive gear disposed inside the first lateral part 152, so that the driving force can be conveyed to the fixing device 80 and the ejector 84.

Then, descriptions are provided for how to install the fixing device 80 in the frame 90 and the structure of the fixing device when situated.

Figure 13:
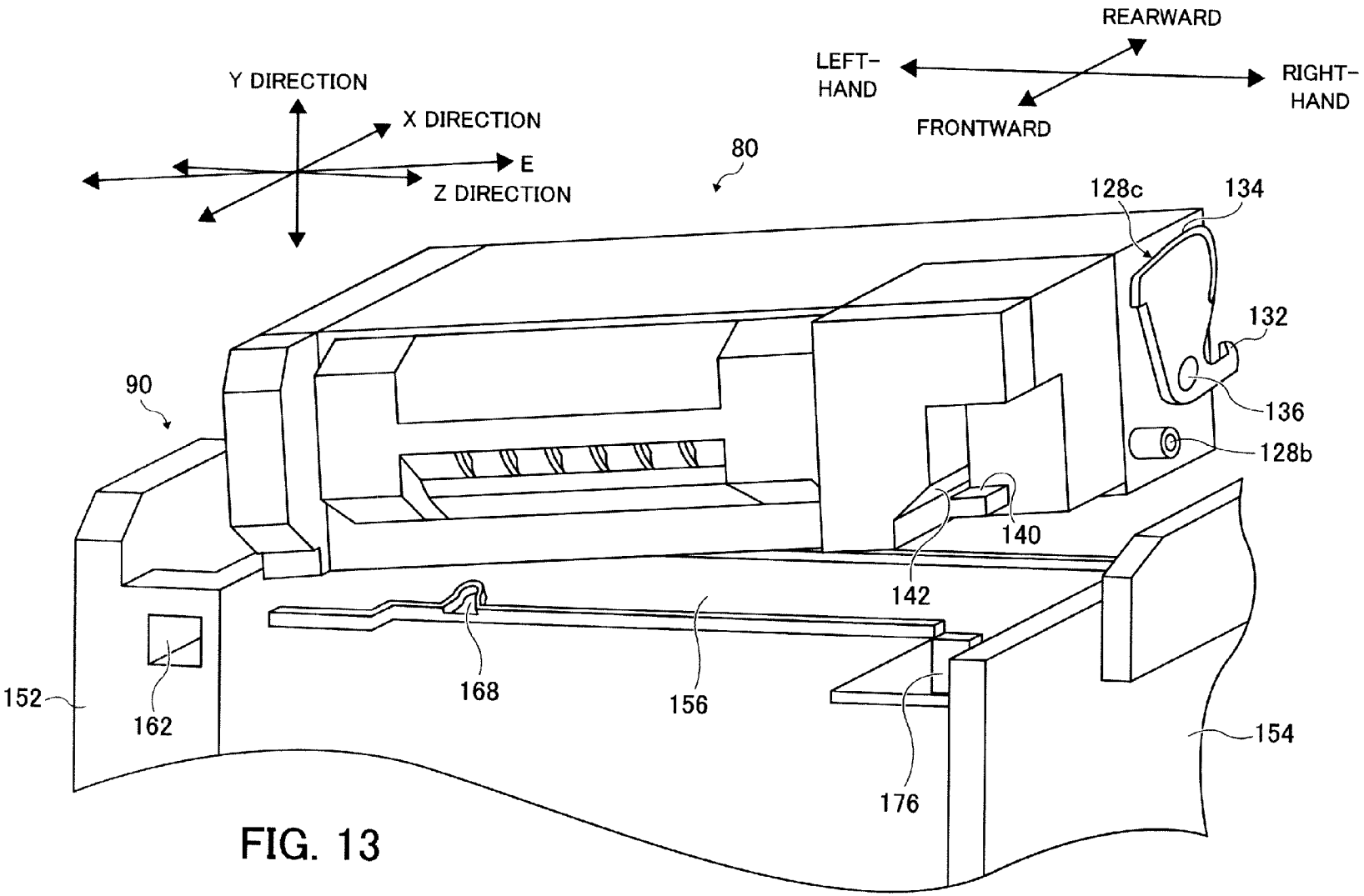
FIG. 13 is a perspective view of the fixing device that is now being installed in or removed from the frame, as viewed from above right at the front side.
Figure 14:
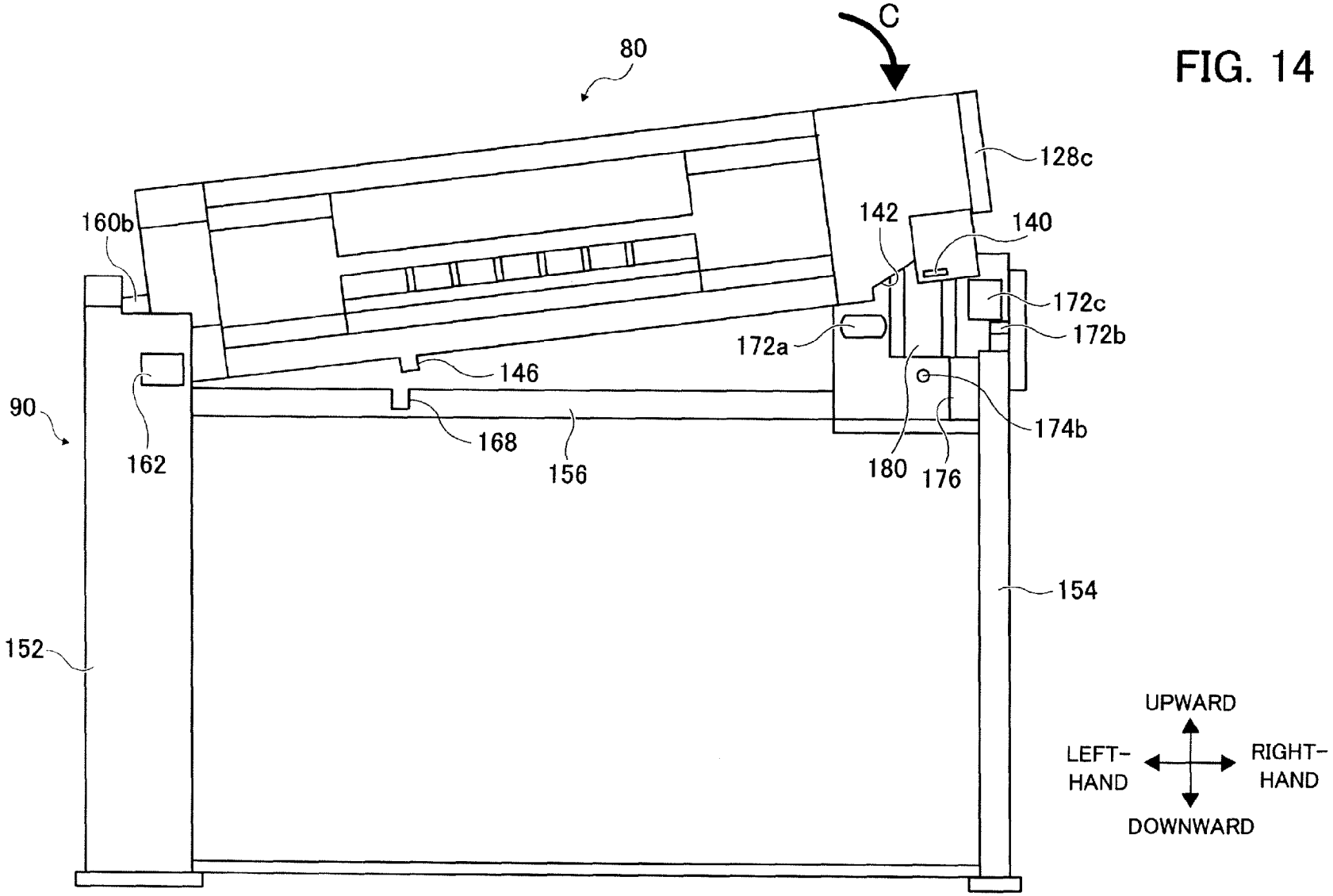
FIG. 14 is a front view of the fixing device that is now being installed in or removed from the frame, as viewed from front.
Figure 15:
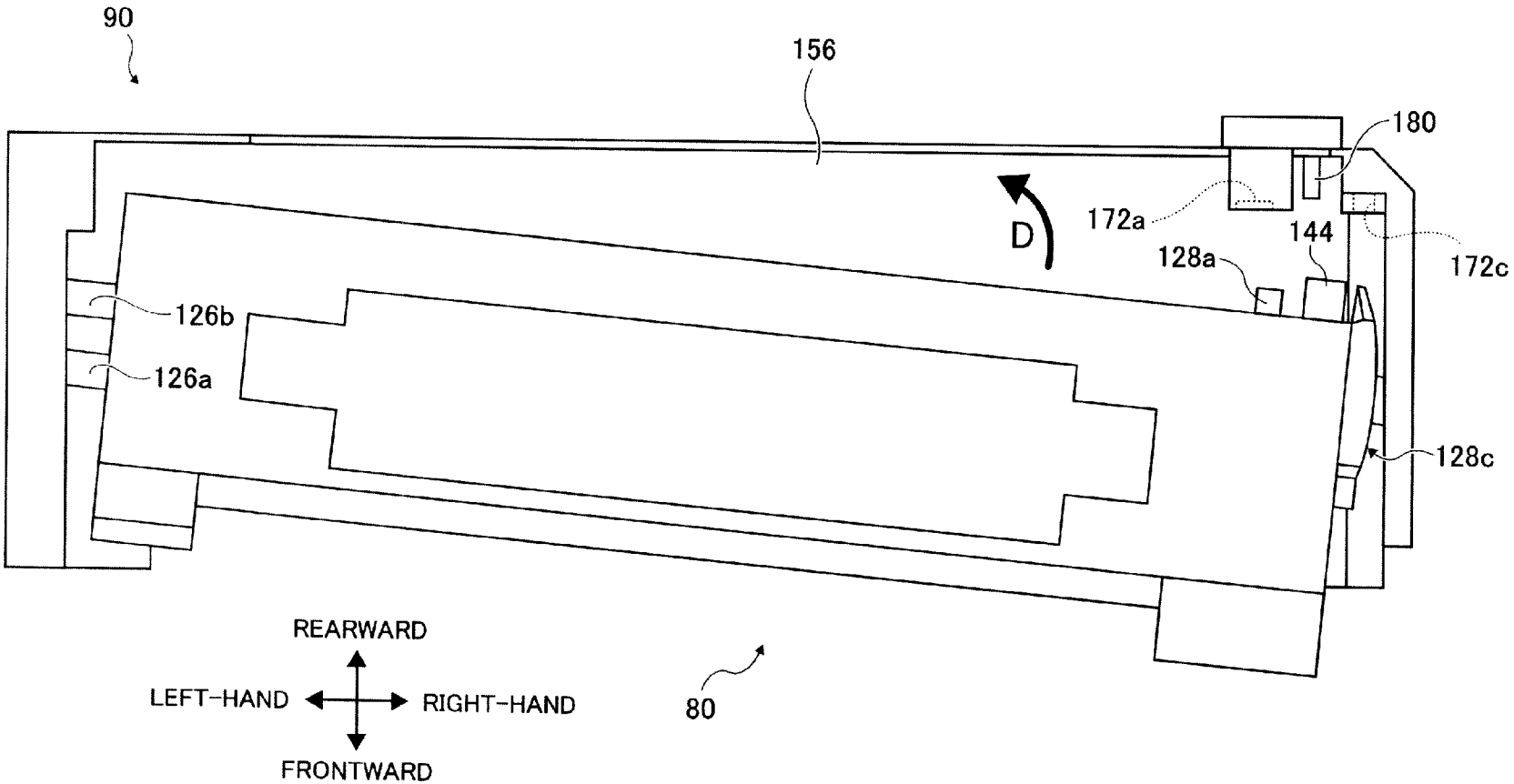
FIG. 15 is a top view of the fixing device that is now being installed in or removed from the frame, as viewed from above.

FIGS. 13 through 15 depict the fixing device 80 that is now installed in or removed from the frame, wherein the left mating portion 126 of the fixing device 80 is attached to the left mated portion 160 of the frame 90.

FIG. 13 is a perspective view of the fixing device as viewed from above right at the front side, FIG. 14 is a front view of the fixing device as viewed from front, and FIG. 15 is a top view of the fixing device as viewed from above.

An operation of installing the fixing device 80 in the frame is described.

First, the open/close operational part 112 of the latching device 100 is pushed inward of the image forming apparatus main body 12. This releases the opening and closing part 24 from a state in which its opening and closing are restricted by the latching device 100. Then, the opening and closing part 24 is opened to expose the frame 90.

Next, the fixing device 80 is slanted so that its left side becomes somewhat lower. From a direction in which the bottom of the fixing device 80 does not come in contact with the frame, the fixing device 80 is moved toward the frame 90 and the first positioning portion 126 is attached to (inserted in) the first positioned portion 160.

This operation may be performed as follows: after restricting the fixing device 80 from moving in the Y direction by inserting the second boss 126*b* into the second boss catcher 160*b*, the first boss 126*a* may be inserted into the first boss catcher 160*a*.

The first boss 126*a* may be inserted before inserting the second boss 126*b*. Alternatively, the first boss 126*a* and the second boss 126*b* may be inserted at the same time.

Subsequently, the fixing device 80 is turned downward (in a direction of arrow C shown in FIG. 14) about the bottom edge of the first boss catcher 160*a* (axis B shown in FIG. 7).

Then, the fixing device 80 is turned rearward (in a direction of arrow D shown in FIG. 15) about the front edge of the first boss catcher 160*a* (axis A shown in FIG. 7).

Then, the opening and closing part 24 is closed. In this way, the fixing device 80 is installed in the frame 90.

When turning the fixing device rearward, in the latch 128*c*, the curve of the hook portion 132 comes in contact with an upper area of the inner wall of the latch catcher 172*c*. Thus, as the fixing device 80 is turned rearward, the hook portion 132 is moved downward. When the fixing device 80 is pushed backward until it comes to a predetermined position, the hook portion 132 moves upward under the urging force of the elastic member.

In this way, the latch 128*c* is engaged with the latch catcher 172*c* even without pulling down the grip portion 134 in the course of installing the fixing device 80.

When closing the opening and closing part 24, the fixing device 80 may not be installed in its proper position if the fixing device 80 is not sufficiently turned rearward or for some reason.

In such a case, in the course of closing the opening and closing part 24, the pressing part 102 of the opening and closing part 24 comes in contact with the pressed portion 140 of the fixing device 80 and pushes the fixing device 80 rearward.

This ensures that the fixing device 80 is installed in its proper position.

When the fixing device 80 is installed in its proper position, the first boss 126*a* and the second boss 126*b* of the first positioning portion 126 of the fixing device 80 are fit securely in the first boss catcher 160*a* and the second boss catcher 160*b* of the first positioned portion 160 of the frame 90, respectively.

Consequently, the left side of the fixing device 80 is restrained from moving in the X and Y directions.

The third boss 128*a* and the fourth boss 128*b* of the second positioning portion 128 are fit securely in the third boss catcher 172*a* and the fourth boss catcher 172*b* of the second positioned portion 172 of the frame 90, respectively. At the same time, the latch 128*c* is fit securely in the latch catcher 172*c*.

Consequently, the right side of the fixing device 80 is restrained from moving in the X and Y directions.

The fifth boss 146 is fit securely in the fifth boss catcher 168. Consequently, the fixing device 80 is restrained from moving in the Z direction.

The fixing device's connector 144 is connected to the frame's connector 180.

In this way, the fixing device 80 is positioned in the frame 90 and fixed with respect to the X, Y, and Z directions.

Next, an operation of removing the fixing device 80 from the frame 90 is described.

First, the opening and closing part 24 is opened to expose the fixing device 80.

Then, the latch 128*c* engaged with the latch catcher 172*c* is disengaged by gripping the grip portion 134 and moving it up.

Subsequently, the fixing device 80 is turned frontward (opposite to the direction of arrow C shown in FIG. 15) about the front edge of the first boss catcher 160*a* (axis A shown in FIG. 7). Here, it is sufficient to move the fixing device 80 until the fixing device's connector 144 is disconnected from the frame's connector 180; for example, the fixing device 80 is moved frontward about 5 degrees.

Subsequently, the fixing device 80 is turned upward (opposite to the direction of arrow D shown in FIG. 14) about the bottom edge of the first boss catcher 160*a* (axis B shown in FIG. 7). Here, it is sufficient to move the fixing device 80 so that the right bottom of the fixing device 80 comes higher than the second lateral part 154; for example, the fixing device 80 is moved upward about 9 degrees.

By drawing out the fixing device 80 to the right and upward (in a direction of arrow E shown in FIG. 13), the first positioning portion 126 is detached from the first positioned portion 160.

In this way, the fixing device 80 is removed from the frame 90.

Next, an operation of pushing in the fixing device 80 is described.

Figure 16C:
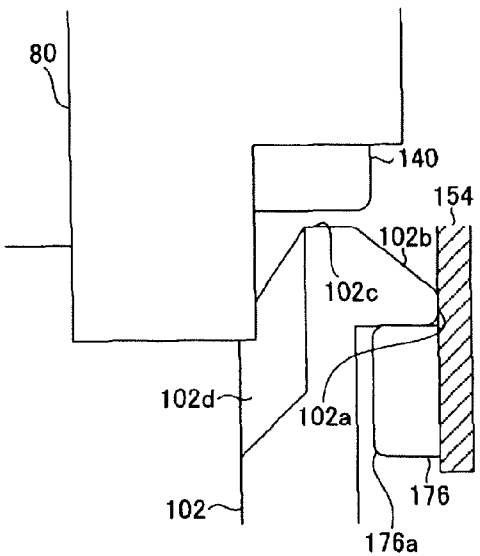
FIGS. 16A, 16B, and 16C illustrate how the pressing part pushes the fixing device in position.
Figure 16B:
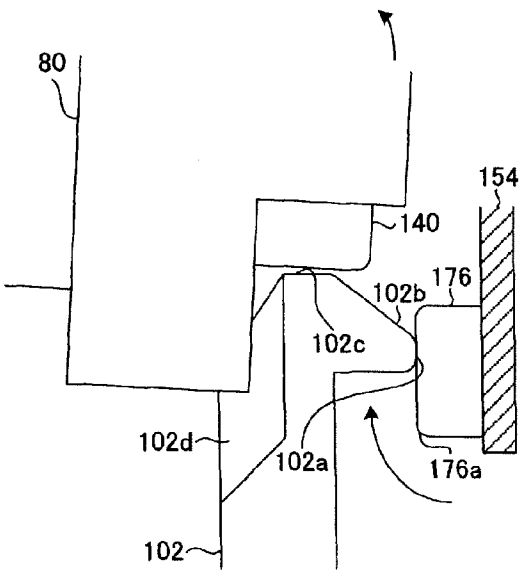
Figure 16A:
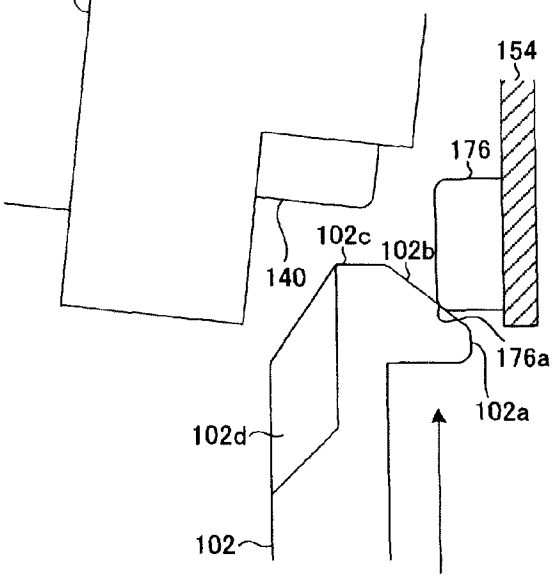

FIGS. 16A, 16B, and 16C depict how the pressing part 102 and the pressed portion 140 interlock when the opening and closing part 24 is closed.

FIG. 16A shows a state where the fixing device 80 is not installed in its proper position.

FIG. 16B shows a state where the fixing device 80 is now being pushed in position by the pressing part 102.

FIG. 16C shows a state where the fixing device 80 is installed in its proper position.

As shown in FIG. 16A, with the closing movement of the opening and closing part 24, the guiding portion 102*b* of the pressing part 102 comes in contact with the tip 176*a* of the second engaged portion 176 provided on the frame 90.

As shown in FIG. 16B, when the pressing part 102 travels rearward (the opening and closing part 24 is moved farther in the closing direction) with the guiding portion 102*b* being in contact with the tip 176*a*, the pressing part 102 is guided by the guiding portion 102*b* and moves leftward against the urging force of the urging member 108. Then, the engaging portion 102*a* of the pressing part 102 comes in contact with the lateral side of the second engaged portion 176.

As shown in FIG. 16C, when the engaging portion 102*a* travels up to the rear side of the second engaged portion 176 (the opening and closing part 24 is moved farther in the closing direction) with the engaging portion 102*a* being in contact with the lateral side of the second engaged portion 176, the pressing part 102 moves rightward under the urging force of the urging member 108.

In parallel with this, the coupling part 104 is engaged with the first engaged portion 162.

During the travel of the pressing part 102 after its guiding portion 102*b* becomes in contact with the tip 176*a* until its engaging portion 102*a* comes up to the rear side of the second engaged portion 176, its tip portion 102*c* comes in contact with the pressed portion 140 of the fixing device 80 when the fixing device 80 is positioned in the movement locus of the engaging portion 102*a*. Thus, the fixing device 80 is pushed rearward toward its proper position as the pressing part 102 travels.

Once the fixing device 80 is installed in position, there is no contact between the pressing part 102 and the fixing device 80 including the pressed portion 140.

The exemplary embodiment described hereinbefore sets forth the mechanism in which the fixing device 80 is pushed in position by the opening and closing part 24. However, the foregoing description is not restrictive and such mechanism may be applied to another functional unit or the like that is movably installed in the image forming apparatus main body 12.

The exemplary embodiment described hereinbefore also sets forth the mechanism in which the fixing device 80 can be turned about its one end and the other end thereof is pushed in by the opening and closing part 24. However, the foregoing description is not restrictive. Alternatively, a mechanism in which both ends of the fixing device 80 are movable and can be pushed in is also allowed.

The present invention may be embodied in other specific forms without departing from its spirit or essential characteristics. The described exemplary embodiment is to be considered in all respects only as illustrated and not restrictive. The scope of the present invention is, therefore, indicated by the appended claims rather than by the foregoing description. All changes which come within the meaning and range of equivalency of the claims are to be embraced within their scope.

What is claimed is:

1. An image forming apparatus comprising:

an image forming apparatus main body;

an opening and closing part that is attached to the image forming apparatus main body in an openable and closeable manner; and a fixing device that is removably installed in the image forming apparatus main body to fix a developer image onto a recording medium, the opening and closing part being provided with an engaging portion to engage with an engaged portion defined on the image forming apparatus main body, wherein the engaging portion includes a pressing part that presses the fixing device toward a proper position when a part of the fixing device is positioned in a movement locus of the engaging portion during a closing movement of the opening and closing part, and wherein the pressing part is separated by a predetermined gap from the fixing device when the opening and closing part is closed and once the fixing device has been installed in the proper position.

2. The image forming apparatus according to claim 1, wherein the opening and closing part includes an urging member that urges the pressing part, and the pressing part includes a guiding portion that guides the engaging portion to the engaged portion against urging force of the urging member.

3. The image forming apparatus according to claim 2, wherein one end of the fixing device in a longitudinal direction is positioned in the image forming apparatus main body through a positioning portion provided at the one end of the fixing device in the longitudinal direction, and the pressing part is disposed at another end of the fixing device in the longitudinal direction.

4. An image forming apparatus comprising:

an image forming apparatus main body;

an opening and closing part that is attached to the image forming apparatus main body in an openable and closeable manner; and a fixing device that is removably installed in the image forming apparatus main body to fix a developer image onto a recording medium, the opening and closing part being provided with an engaging portion to engage with an engaged portion defined on the image forming apparatus main body, wherein the engaging portion includes a pressing part that presses the fixing device toward a proper position when a part of the fixing device is positioned in a movement locus of the engaging portion during a closing movement of the opening and closing part, wherein one end of the fixing device in a longitudinal direction is positioned in the image forming apparatus main body through a positioning portion provided at the one end of the fixing device in the longitudinal direction, and wherein the pressing part is disposed at another end of the fixing device in the longitudinal direction.

5. An image forming apparatus comprising:

an image forming apparatus main body;

an opening and closing part that is attached to the image forming apparatus main body in an openable and closeable manner; and a fixing device that is removably installed in the image forming apparatus main body to fix a developer image onto a recording medium, the opening and closing part being provided with an engaging portion to engage with an engaged portion defined on the image forming apparatus main body, the engaging portion being movable in an orthogonal direction with respect to an opening/closing direction of the opening and closing part, the image forming apparatus main body being provided with a protrusion, during a closing movement of the opening and closing part, the engaging portion coming in contact with the protrusion and being moved in the orthogonal direction, and after the engaging portion is moved in the orthogonal direction, the engaging portion pressing the fixing device toward a proper position when at least a part of the fixing device is positioned in a movement locus of the opening and closing part along the opening/closing direction.

6. The image forming apparatus according to claim 5, wherein the engaging portion includes a pressing part, and wherein the pressing part is separated by a predetermined gap from the fixing device when the opening and closing part is closed and once the fixing device has been installed in the proper position.

7. The image forming apparatus according to claim 5, wherein the engaging portion includes a pressing part, wherein one end of the fixing device in a longitudinal direction is positioned in the image forming apparatus main body through a positioning portion provided at the one end of the fixing device in the longitudinal direction, and wherein the pressing part is disposed at another end of the fixing device in the longitudinal direction.

8. The image forming apparatus according to claim 5, wherein the engaging portion includes a pressing part, and wherein once the fixing device has been installed in the proper position, there is no contact between the pressing part and the fixing device.

* * * * *